US005391045A

United States Patent [19]

Raasch et al.

[11] Patent Number: 5,391,045

[45] Date of Patent: Feb. 21, 1995

[54] CAN MANIPULATING DEVICE FOR AUTOMATIC CAN EXCHANGE

[75] Inventors: Hans Raasch; Hans-Werner Schwalm, both of Mönchengladbach, Germany

[73] Assignee: W. Schlafhorst AG & CO., Moenchengladbach, Germany

[21] Appl. No.: 198,206

[22] Filed: Feb. 17, 1994

Related U.S. Application Data

[63] Continuation of Ser. No. 948,029, Sep. 21, 1992, abandoned.

[30] Foreign Application Priority Data

Sep. 21, 1991 [DE] Germany ..... 4131455

[51] Int. Cl.[6] ..... D01H 9/18

[52] U.S. Cl. ..... 414/626; 414/225; 414/911; 294/67.31; 57/281; 19/159 A

[58] Field of Search ..... 414/225, 226, 591, 623, 414/626, 753, 911, 736, 745.2, 751; 294/67.31, 106, 115; 57/90, 281; 19/159 A; 901/39

[56] References Cited

U.S. PATENT DOCUMENTS

| | | | |
|---|---|---|---|
| 2,924,484 | 2/1960 | Tolsma | 414/626 X |
| 3,029,100 | 4/1962 | Laine | 414/626 X |
| 3,158,275 | 11/1964 | Hart | 414/623 |
| 4,108,485 | 8/1978 | Jennings | 294/67.31 X |
| 4,150,534 | 4/1979 | Raasch | 57/281 |
| 4,693,017 | 9/1987 | Oehler et al. | 294/67.31 X |
| 4,929,012 | 5/1990 | Slezak | 294/115 X |
| 4,939,895 | 7/1990 | Raasch et al. | 57/281 X |
| 4,968,212 | 11/1990 | McNamara | 414/911 X |
| 5,017,075 | 5/1991 | Block | 414/225 |
| 5,067,204 | 11/1991 | Shinkai et al. | 19/159 A |

FOREIGN PATENT DOCUMENTS

| | | | |
|---|---|---|---|
| 340459 | 11/1989 | European Pat. Off. . | |
| 2613237 | 10/1977 | Germany | 414/911 |
| 1325003 | 7/1987 | U.S.S.R. | 414/626 |

*Primary Examiner*—David A. Bucci
*Assistant Examiner*—James W. Keenan
*Attorney, Agent, or Firm*—Herbert L. Lerner; Laurence A. Greenberg

[57] ABSTRACT

Sliver-processing textile machines and can exchange stations include a can transport carriage to be moved in a given direction of motion for manipulating sliver cans having upper rims with outer peripheries. A can manipulating device is movable on the can transport carriage above the cans in a direction transverse to the given direction of motion for manipulating the sliver cans during an automatic can exchange. Four gripper elements for gripping the sliver cans to be manipulated are disposed at four mutually spaced-apart locations at the outer peripheries of the upper rims of the cans.

11 Claims, 9 Drawing Sheets

CAN MANIPULATING DEVICE FOR AUTOMATIC CAN EXCHANGE

This application is a continuation, of application Ser. No. 07/948,029, filed Sep. 21, 1992, now abandoned.

BACKGROUND OF THE INVENTION

1. Field of the Invention

The invention relates to a can manipulating device on a can transport carriage for manipulating sliver cans during an automatic can exchange at sliver-processing textile machines and can exchange stations, wherein the can manipulating device is movable above the cans to be manipulated transversely to the direction of movement of the can transport carriage.

Can transport carriages are utilized in order to simplify and automate can transport and the exchange of empty cans for full cans at spinning stations and of empty cans for full cans at can exchange stations. Such can transport carriages simultaneously carry can manipulating devices with which the can exchange is performed.

2. Description of the Related Art

A can transport carriage with a so-called manipulator is known from German Published, Non-Prosecuted Application DE-OS 38 31 638, corresponding to U.S. Pat. No. 4,998,406. The manipulator disclosed therein has two controllable can grippers. For example, when empty cans are to be taken up at a spinning machine, the manipulator extends transversely to the direction of movement of the can transport carriage with opened can grippers, in order to be positioned above the can to be exchanged. Usually, the cans are disposed below a spinning machine in two rows, one behind the other. Often, a row of full cans stands ready in reserve in front of the two rows of cans from which the sliver runs into the individual work stations. The spaces remaining among the cans are narrow and quite often irregular. Usually, the cans do not assume their theoretically exactly determined positions assigned to them at a certain work station. Due to the irregular can configuration it is possible for the grippers to bump the cans during their insertion between the cans. In this way, the cans may be further displaced from their already inaccurate position and in the worst case, for instance, empty cans may fall over. Furthermore, it is possible for the can grippers to not grip the can to be exchanged exactly at the intended locations, which impairs a simple exchange of sliver cans.

SUMMARY OF THE INVENTION

It is accordingly an object of the invention to provide a can manipulating device for automatic can exchange, which overcomes the hereinafore-mentioned disadvantages of the heretofore-known devices of this general type and with which sliver cans can be safely gripped and transported without interference by the adjacent cans.

With the foregoing and other objects in view there is provided, in accordance with the invention, in sliver-processing textile machines and can exchange stations including a can transport carriage to be moved in a given direction of motion for manipulating sliver cans having upper rims with outer peripheries, a can manipulating device being movable on the can transport carriage above the cans in a direction transverse to the given direction of motion for manipulating the sliver cans during an automatic can exchange, comprising four gripper elements for gripping the sliver cans to be manipulated at four mutually spaced-apart locations at the outer peripheries of the upper rims of the cans.

The can manipulating device according to the invention has four gripper elements for gripping the sliver cans to be manipulated at the respective outer peripheries of the upper rim. They are disposed relative to the perimeter of the can to be gripped in such a way that they may grip the can to be lifted outside of the possible points of contact among the cans. When sliver cans stand in at least three rows next to one another and behind one another under the work stations of a sliver-processing textile machine, then they may stand in contact with adjacent sliver cans at four locations at their outer perimeter. The can grippers of prior art can manipulating devices were forced to grip the can at two respectively opposite, possible points of contact of the cans. It was thereby possible for the adjacent, abutting cans to be displaced from their spot.

However, the can manipulating device according to the invention lowers the gripper elements into the region of the greatest intermediate spaces among the cans, namely where they cannot abut. Therefore, in accordance with another feature of the invention, the cans are disposed adjacent and behind one another in rows defining areas of greatest intermediate spaces between the cans, and the gripper elements grip the cans in the areas of greatest intermediate spaces.

These regions are disposed relative to one another at an approximately 90 degree distribution about the circumference of the can to be gripped, when the cans are disposed according to a quadratic grid. In the most densely packed configuration of the cans, the regions of the greatest spacing among the cans are distributed at a respective distance of 60 degrees. In the middle row of three rows of cans, six cans may be grouped about one can. No adjacent cans are bumped or knocked over with the can manipulating device according to the invention. The can to be grabbed is positioned among the four gripper elements and it can be safely gripped and held during transport. The cans are deposited exactly in position, since the four gripper elements distributed about the circumference of the rim of the can have a centering effect when a can is taken up, which always moves the can into the same position on the can manipulating device.

In accordance with a further feature of the invention, there are provided mutually parallel holders each being connected to a respective two of the gripper elements, the holders being parallel to the direction of movement of the can manipulating device, and each two of the gripper elements connected to one of the holders being disposed one behind the other as seen in the directions of movement of the can manipulating device.

In accordance with an added feature of the invention, there are provided means for raising and lowering the gripper elements for lifting and depositing the cans with substantially vertical lifting strokes, and means for pivoting the gripper elements for gripping and releasing the cans in any lifting position.

The fact that the gripper elements for picking up and setting down the cans are disposed in such a way that they can be raised and lowered nearly vertically, makes use of the small spaces which are available for the gripper elements among closely positioned cans. Furthermore, the gripper elements are pivotable in any lifting position for gripping and releasing cans. It is thus ensured that the cans can be safely transported to and fro and can be positioned exactly in the case of a level difference between the position under the work stations of a sliver-processing textile machine and the can transport carriage.

In accordance with an additional feature of the invention, there are provided lifter arms for raising and lowering the gripper elements, each two of the gripper elements being disposed behind one another in the directions of movement of the can manipulating device and being pivotally mounted on at least one of the lifter arms, the lifter arms being in operative connection for synchronously raising and lowering the gripper elements, an actuating device for actuating the lifter arms, parallel levers for pivoting the gripper elements, coupling members connecting the parallel levers with the gripper elements, the parallel levers being operatively connected for synchronously pivoting the gripper elements, and an actuating device for actuating the parallel levers.

In accordance with yet another feature of the invention, the lifter arms and the parallel levers include lifter arms and parallel levers being disposed one above the other for actuating the same one of the gripper elements, the parallel levers are disposed above the lifter arms, and there are provided pivot lever pairs, the parallel levers being connected with the lifter arms by the coupling members and the pivot lever pairs for actuating the gripper elements.

In accordance with a concomitant feature of the invention, there are provided mutually articulatingly coupled members and a joint interconnecting the coupled members, the lifter arms and the parallel levers being connected by the coupled members, and the actuating member for the parallel levers engaging the joint.

Other features which are considered as characteristic for the invention are set forth in the appended claims.

Although the invention is illustrated and described herein as embodied in a can manipulating device for automatic can exchange, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 5*a*, 5*b*, 5*c* and 5*d* are fragmentary, elevational views of four illustrations showing cooperation among individual elements of the can manipulating device in four positions, wherein FIG. 5*a* shows a starting position with gripper elements closed, FIG. 5*b* shows the starting position with gripper elements open, FIG. 5*c* shows gripper elements which are lowered and open, and FIG. 5*d* shows gripper elements which are closed and a can being gripped;

DESCRIPTION OF THE PREFERRED EMBODIMENT

Figure 1:
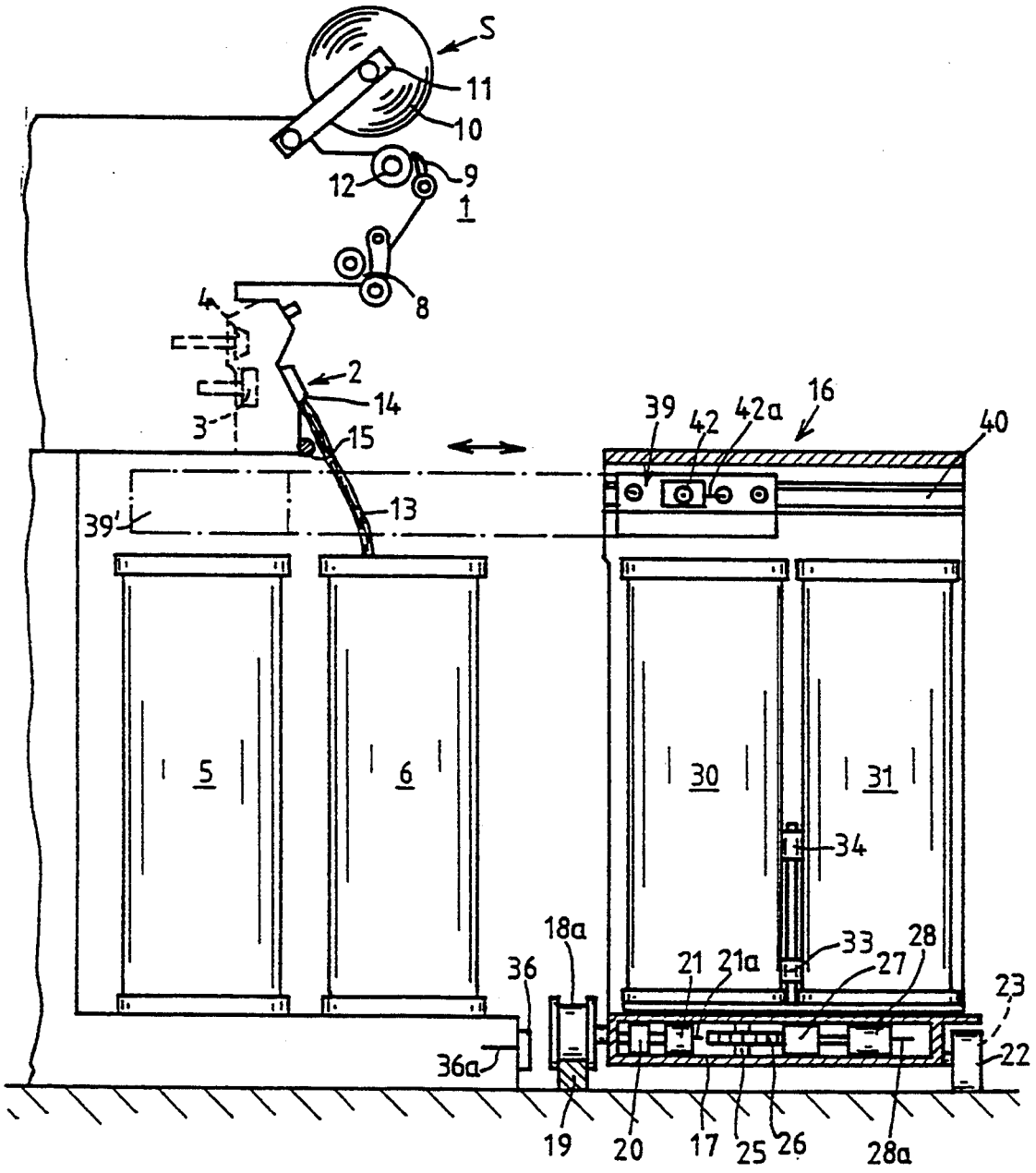
FIG. 1 is a fragmentary, diagrammatic, partly-sectional, elevational view of a can transport carriage, which stands ready in front of a spinning station of a spinning machine for performing a can exchange by means of a can manipulating device according to the invention.

Referring now in detail to the figures of the drawing, in which only those features that contribute to an understanding of the invention are illustrated and described in the exemplary embodiment, and first, particularly, to FIG. 1 thereof, there is seen a spinning station of an open-end spinning machine S, which includes a plurality of adjacent spinning stations. A dissolving device 3 and a yarn forming element 4 in the form of a rotor are disposed in each so-called spinning box 2. Below each of the spinning boxes 2 are two sliver cans which stand one behind the other at a spinning station 1 and a spinning station located behind it. The sliver cans at the spinning station 1 are numbered with reference numerals 5 and 6. The can 5, which stands in the rear as it is seen from the front of the spinning machine S, has run empty. Accordingly, a draw-off tubule 7 of a draw-off roller pair 8 does not draw off yarn and wind it onto a cross-wound bobbin 10 through a yarn guide 9. Due to the missing sliver, a yarn interruption has occurred and a bobbin holder 11 has lifted the cross-wound bobbin 10 from a winding roller 12. On the other hand, sliver 13 is drawn from the sliver can 6 into a compactor, condenser or reducer 14 of the spinning box in the rearward spinning station. The sliver 13 thereby glides over a deflecting rod 15.

Figure 2:
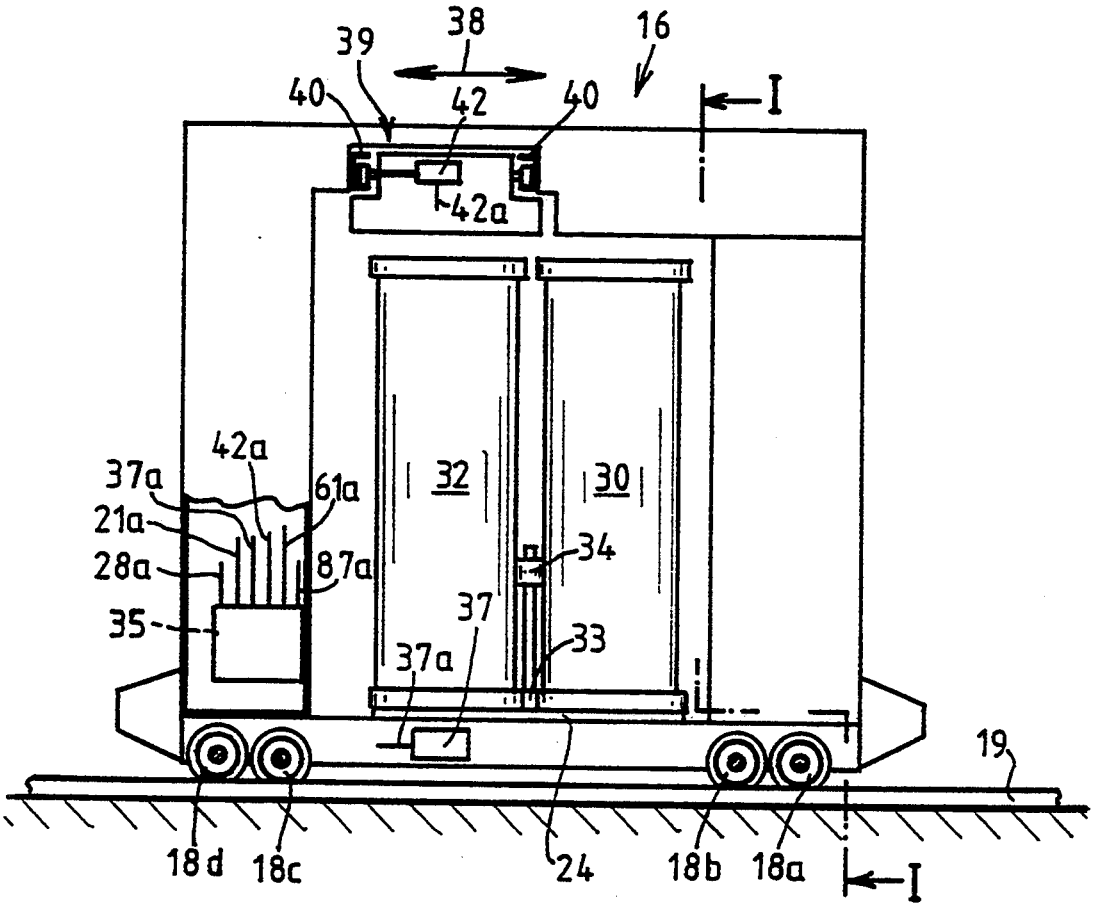
FIG. 2 is an elevational view of the can transport carriage as seen from the spinning machine.

A can transport carriage 16 is positioned in front of the spinning stations. The can transport carriage includes a carriage frame 17 which has four flanged rollers 18*a* to 18*d*, as can be seen in FIG. 2. Each two flanged rollers 18*a*, 18*b* and 18*c*, 18*d* are combined into a respective flanged roller pair. Each flanged roller pair is attached to the carriage frame in a non-illustrated flexible manner, so as to make it capable of travelling about small curve radii. The flanged rollers 18*a* to 18*d* travel on a rail 19, which extends along the spinning machine and which provides for an accurate track guidance of the can transport carriage. The flanged roller pair 18*a*, 18*b* is driven by a motor 21 through a transmission 20. The can carriage is supported on two additional wheels 22 and 23 on the side opposite the flanged rollers.

As can be seen from FIG. 2, the rear part of the can transport carriage along a section line I—I has been omitted, so as to enable a view onto the can manipulating device and onto a turntable with prepared cans. Above the carriage frame 17 of the can transport carriage 16 there is disposed a horizontal turntable 24, which is rotatable about a vertical axle 25. A gear wheel 26 which is disposed on the axle 25, meshes with a transmission 27, which in turn is driven by a motor 28.

The construction of the can transport carriage 16 essentially corresponds to that known from German Published, Non-Prosecuted Application DE-OS 38 31 638, corresponding to U.S. Pat. No. 4,998,408. Four parking positions for cans are provided on the turntable 24, as can be seen from the way that the turntable is occupied. Due to the illustrations in FIGS. 1 and 2, only three cans 30, 31 and 32 can be seen. The cans are separated from one another by means of stop ledges 33 for positioning on the respective parking positions. Furthermore, respective stop rollers 34 for the exact positioning of the cans are disposed at such a height that the cans cannot fall over when they are set down on the turntable and while the turntable turns.

A request for the can transport carriage 16 is issued by a control and checking system of the spinning machine, which is not illustrated in detail, but which communicates with a control system 35 of the can transport carriage 16. When a can runs empty at a spinning station, such as the can 5 at the spinning station 1 in the instant embodiment, then the can transport carriage 16 is requested. The control system of the spinning machine issues a request signal at the requesting spinning station through a signal line 36*a* and a signal transmitter 36, which is received by a receiver 37 on the can transport carriage 16 driving alongside the spinning machine. The receiver 37 on the can transport carriage transmits the received signal to the control device 35 of the can transport carriage over a signal line 37*a*. The control device 35 controls the drive motor 21 of the flanged rollers 18*a* and 18*b* over a signal line 21*a*, so that the can transport carriage 16 sets off in the direction of the requesting winding station, as is symbolized by a double arrow 38.

The can transport carriage 16 is stopped when it has positioned itself at the requesting spinning station across from the can to be exchanged. At this point, the signal transmitter 36 and the receiver 37 must be directly opposite one another. The motor 28 for driving the turntable 24 receives an order over a signal line 28*a* from the control device 35 to rotate the turntable into a position which makes a can exchange possible.

As is shown in FIGS. 1 and 2, the can transport carriage has a portal-like structure. A can manipulating device 39 according to the invention is disposed above the cans which are disposed on the turntable 24. The can manipulating device 39 is suspended in a rail system 40 which can be extended in a telescope-like fashion and which is mounted in a lintel above two adjacent parking positions on the turntable 24. The can manipulating device is drivable transversely to the direction of movement 38 of the can transport carriage 16, as is indicated by a double arrow 41 in FIG. 1. A motor 42, which communicates with the control system 35 of the can transport carriage over a signal line 42*a*, drives the can manipulating device 39 and takes care of its accurate positioning for a can changing operation. The accurate positioning is indicated in FIG. 1 by a phantom position 39' of the can manipulating device above the can 5.

The structure and function of the can manipulating device 39 will be explained with the aid of illustrations which are described below.

Figure 3:
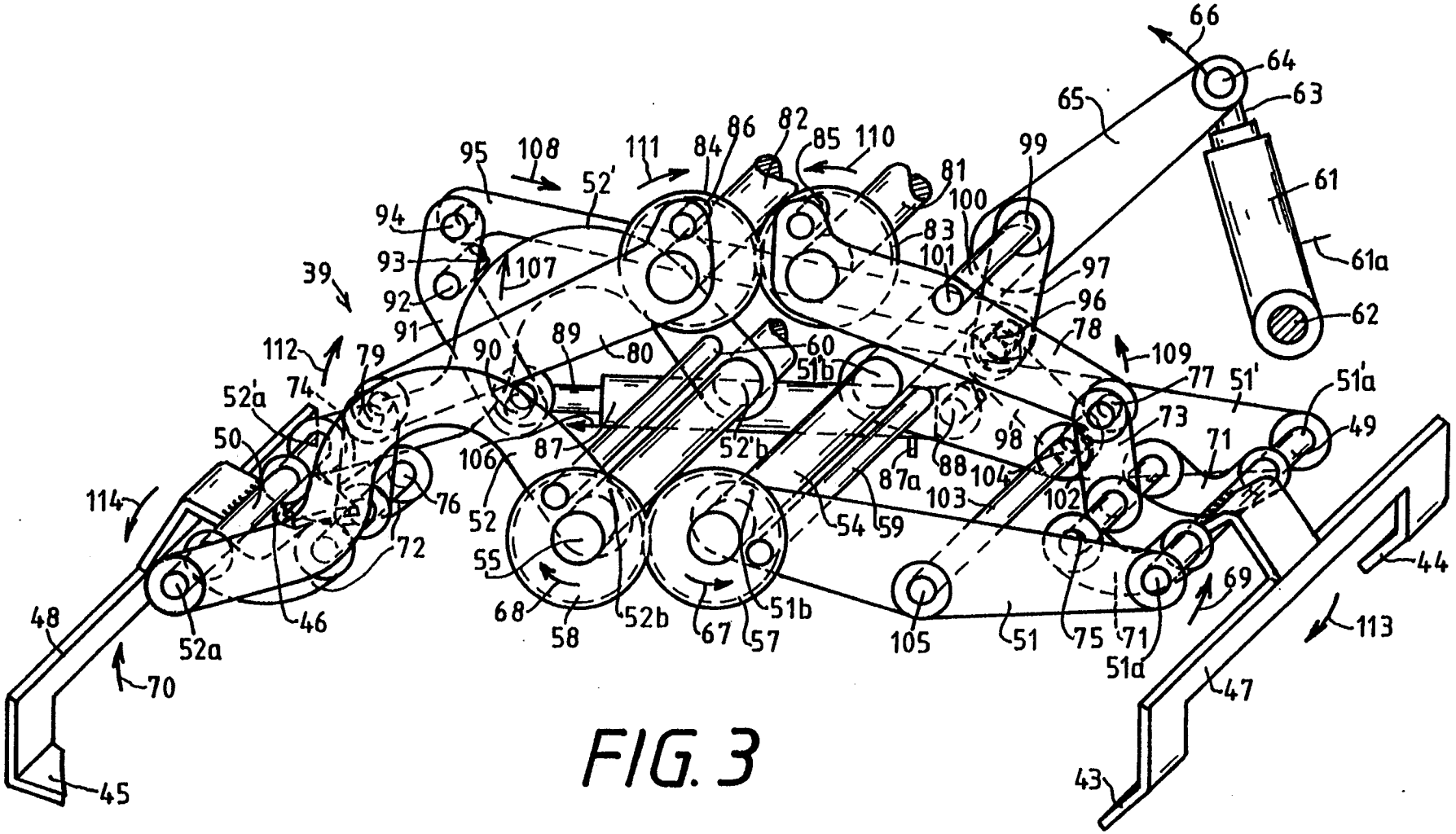
FIG. 3 is a perspective view showing the construction of the can manipulating device.

The perspective view of FIG. 3 shows individual elements of which the can manipulating device 39 is formed. The can manipulating device 39 has a housing which is omitted in order to simplify the overview of the device, and spaces between the individual elements are illustrated as being greater than they would be in a scaled-down view which is true to scale. Furthermore, the individual elements of the can manipulating device are depicted in a simplified fashion.

The can manipulating device 39 has four gripper elements 43, 44, 45 and 46. Each two of the four gripper elements are disposed on a common holder. The two gripper elements 43 and 44 are disposed on a right-hand holder 47 and the gripper elements 45 and 46 are disposed on a left-hand holder 48. The holders 47 and 48 are disposed at a mutual distance which corresponds approximately to the can diameter. This can also be seen from FIG. 4. The mirror-like construction of the can manipulating device due to the disposition of two respective gripper elements in mutually opposite pairs, means that those elements provided for operating the right-hand holder 47 correspond to those elements which operate the left-hand holder 48. The operation of the holders, and therefore of the gripper elements, occurs simultaneously. The holders 47 and 48 are pivotally mounted on respective shafts 49 and 50. In order to operate the gripper elements for opening and closing, the shafts with the holders are supported in so-called lifting arms. These lifting arms permit raising and lowering of the holders with the gripper elements. The lifting arms are disposed between the holders which are mutually opposite one another, in a mirror image relative to the direction of movement 41 of the can manipulating device 39. For reasons of stability, a lifting arm pair are provided for each of raising and lowering each holder. The holder 47 is mounted by way of its shaft 49 in respective bearings 51*a* and 51'*a* which are each disposed at a free end of a lifting arm of a lifting arm pair 51, 51'. The holder 48 with the two gripper elements 45 and 46, is held by an adjacent lifting arm pair 52, 52'. The shaft 50 is rotatably supported with free ends thereof being disposed in bearings 52*a* and 52'*a*.

Figure 4:
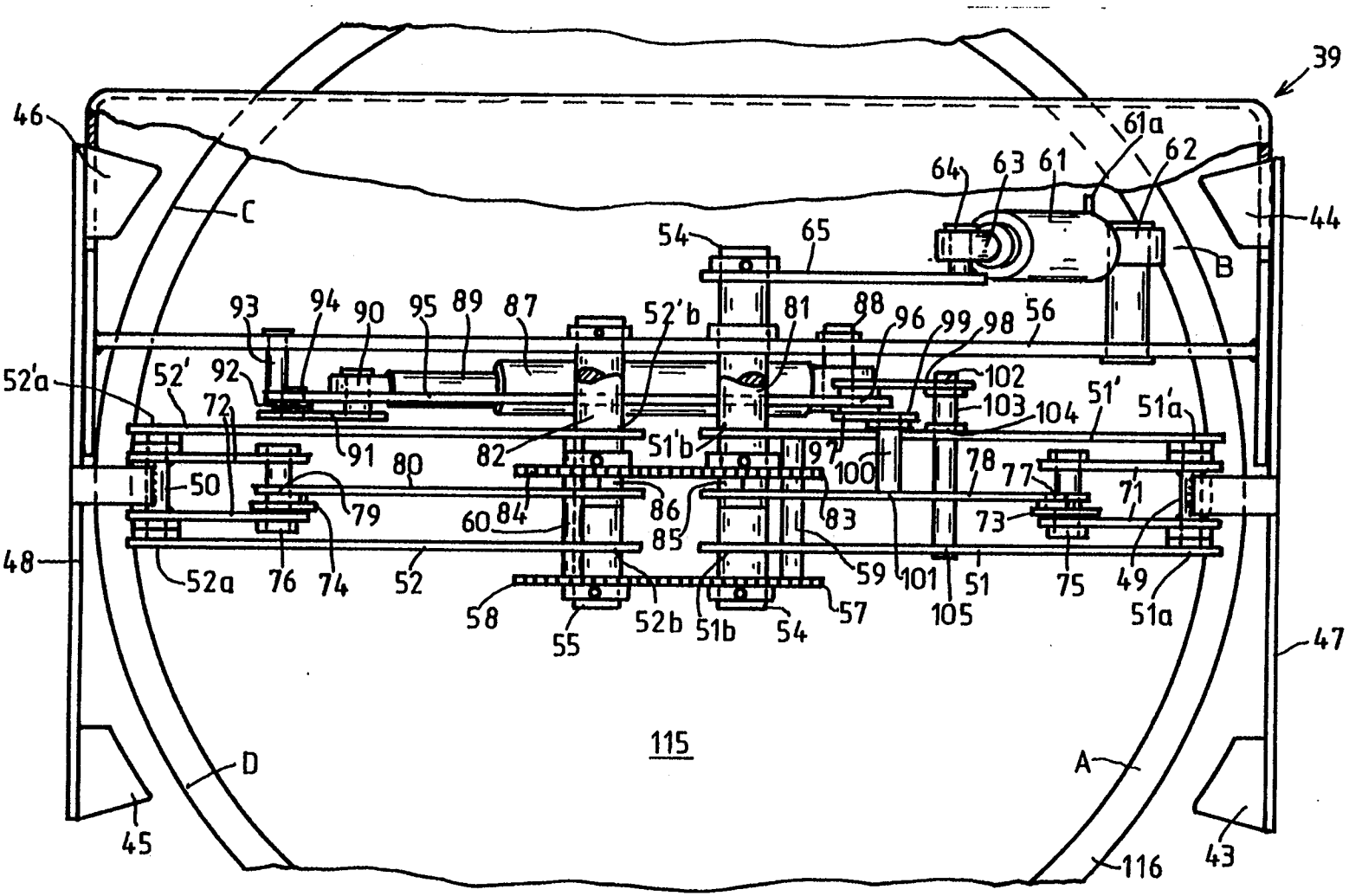
FIG. 4 is a fragmentary, top-plan view of the can manipulating device.

The ends of each of the lifting arms which face each other are rotatably supported on a respective shaft 54 and 55 of the lifting arms 51 and 51' in respective bearings 51*b* and 51'*b*. The two shafts 54 and 55 are rotatably supported in a housing wall 56 of the can manipulating device 39, as is seen in FIG. 4. Gear wheels 57 and 58 are mounted on the respective shafts 54 and 55. The gear wheels mesh with each other. The lifting arms 51, 51' and 52, 52' which are rotatably supported on the respective shafts 54 and 55, are rigidly connected with the gear wheel disposed on the respective shaft. Accordingly, the lifting arms of the pair 52, 52' are connected to one another by a fixing bolt 60 and are rigidly connected with the gear wheel 58.

As is seen in FIG. 4, the shaft 54 which carries the gear wheel 57 protrudes through the housing wall 56 in which it is supported. An actuating member for the lifting arms in the form of a pneumatic cylinder 61, is located behind that wall. The pneumatic cylinder 61 is rigidly connected by a joint 62 to the wall 56, and thus to the housing of the can manipulating device 39. The pneumatic cylinder is connected by a control line 61*a* with the control device 35 of the can transport carriage. A piston 63 of the pneumatic cylinder 61 has a joint 64 at an upper end thereof in which one end of an actuating lever 65 is mounted. Another end of the actuating lever 65 is mounted on the shaft 54 and rigidly connected therewith, as can be seen in FIG. 4. When the pneumatic cylinder 61 is actuated over the control line 61*a*, the piston 63 is driven out and pivots the actuating lever 65 in the direction of an arrow 66. Accordingly, the shaft 54 and therefore also the gear wheel 57 mounted thereon, rotate counter-clockwise in the direction of an arrow 67. Since the gear wheel 57 meshes with the gear wheel 58, the latter is rotated clockwise, in the direction of an arrow 68. Since the lifting arm pairs 51, 51' and 52, 52' are rigidly interconnected by respective fixing rods 59 and 60 and with the respective gear wheels 57 and 58, they are raised upwards, as is indicated by arrows 69 and 70. When the piston 63 of the pneumatic cylinder 61 is again retracted, the lifting arms are lowered.

The gripping of the cans is effected with the gripper elements 43 to 46. In order to enable the gripping of the cans at the can rim, the gripper elements must be pivoted for opening and closing. The pivoting motions are performed with the aid of parallel levers 78 and 80. For that purpose, each holder 47 and 48 of the gripper elements is rigidly connected with a pivot lever pair. Each pivot lever pair is connected with a parallel lever by a coupling member. A pivot lever pair 71 is rigidly connected with the holder 47 and is mounted in such a way as to be rotatable about the shaft 49. A pivot lever pair 72 is rigidly connected with the holder 48 and is mounted in such a way as to be rotatable about the shaft 50. The pivot levers are disposed in pairs. In order to provide a stable bearing for coupling members 73 and 74, and furthermore to attain an even load distribution during operation, the coupling members engage between a respective pivot lever pair. The coupling members 73 and 74 are rotatably mounted on respective shafts 75 and 76 which interconnect the respective pivot lever pairs 71 and 72. The coupling members are each pivotally connected with a parallel lever. The coupling member 73 is connected to the parallel lever 78 in a pivot point 77. The coupling member 74 is connected to the parallel lever 80 in a joint 79. The parallel lever 78 is pivotally mounted on a shaft 81, which is supported in the wall 56 of the housing. The parallel lever 80 is pivotally mounted on a shaft 82, which is also supported in the wall 56 of the housing. A gear wheel 83 is mounted on the shaft 81. A gear wheel 84 is mounted on the shaft 82. The two gear wheels mesh with one another. The parallel lever 78 is rigidly connected with the gear wheel 83 by a connecting bolt 85. The parallel lever 80 is rigidly connected with the gear wheel 84 by a connecting bolt 86. The two parallel levers rotate in opposite directions when the gear wheels rotate. Depending on the rotational direction of the gear wheels, the parallel levers 78 and 80 perform a lifting or a lowering motion.

The pivoting of the gripper elements 43 to 46 for gripping the cans is effected by a pneumatic cylinder 87, which is supported in a joint 88 in the wall 56 and which is connected with the control device 35 of the can transport carriage through a control line 87*a*. A piston 89 has a joint 90 on one end in which an actuating lever 91 is pivotally mounted. The actuating lever 91 is slightly bent. A joint 92 is disposed in the bend. The actuating lever 91 is pivotally attached to the wall 56 by a bolt 93. A connecting bar 95 is attached in a joint 94 at the other end of the actuating lever 91. The connecting bar 95 provides a connection to the parallel levers 78 and 80. However, the connecting bar 95 does not directly engage the parallel levers. The connecting bar 95 has a joint 96 at an end thereof in which two members 97 and 98 are supported. The member 97 has an end opposite the joint 96 at which it carries a joint 99, in which a bolt 100 is pivotally mounted. The bolt 100 is attached to the parallel lever 78 at a point 101, approximately halfway between the joint 77 and the joint on the shaft 81. The member 98, which has the same length as the member 97, carries a joint 102 on an end thereof opposite the joint 96. A connecting bolt 103 is rotatably supported in the joint 102. The connecting bolt 103 is rotatably mounted in a joint 104 in the lifting arm 51' and is rotatably in a joint 105 in the lifting arm 51.

When the pneumatic cylinder 87 is actuated over the control line 87*a* and the piston 89 is driven out in the direction of an arrow 106, the actuating lever 91 is pivoted about the joint 92 in the direction of an arrow 107. The connecting bar 95 is thereby pushed in a direction 108. The connecting bar 95 engages the two members 97 and 98 in the joint 96, and the members 97 and 98 are pushed from the illustrated bent position into an extended position, in which they are aligned with one another. The member 98 thereby rests on the connecting bolt 103, which is supported in the lifting arms 51 and 51' and which can rotate about the shaft 54. However, since the piston 61 is not actuated, the shaft 54 cannot rotate either. Any movement of the lifting arms is thus blocked. Accordingly, only the two parallel levers 78 and 80 can turn. During the transition of the members 97 and 98 into a mutually extended position, the bolt 100 of the parallel levers 78 is lifted upwards in the direction of an arrow 109. The parallel lever 78 pivots about the shaft 81 and it takes the gear wheel 83 with it through the connecting bolt 85. Accordingly, the gear wheel 83 rotates counter-clockwise in the direction of an arrow 110. The gear wheel 83 meshes with the gear wheel 84, which therefore rotates clockwise according to an arrow 111. The parallel lever 80 is moved along by the connecting bolt 86 and it rotates about the shaft 82. It also moves upward in the direction of an arrow 112. The parallel levers 78 and 80 thus pull on the coupling members 73 and 74. The shaft 75 is mounted in the coupling member 73, the shaft 76 is mounted in the coupling member 74 and the pivot lever pairs 71 and 72 are pivotally attached to the shafts. The pivot lever pairs 71 and 72 are rigidly connected with the respective holders 47 and 48. Therefore, each movement of the pivot lever pairs 71 and 72 is transferred to the respectively connected holder. The holder 47 rotates about the shaft 49 on which it is mounted, and the holder 48 rotates about the shaft 50 on which it is mounted. The pivoting motion of the parallel levers 78 and 80 in the direction of the respective arrows 109 and 112 effects an inward pivoting of the holders, one towards the other. The holder 47, with its gripper elements 43 and 44, pivots inwardly clockwise according to an arrow 113. The holder 48, with the gripper elements 45 and 46, pivots inwardly counter-clockwise in the direction of an arrow 114. The gripper elements 43 to 46 can thereby engage under the edge of a can that is ready, for gripping and holding the same in a centered fashion.

In FIG. 4, a can 115 stands ready below the can manipulating device 39. When the gripper elements 47 and 48 are pivoted according to the directions of movement 113 and 114, as is illustrated in FIG. 3, the gripper elements can engage under an edge 116 of the ready can 115 at points A, B, C and D, and can hold the same centered. The gripper elements are adapted to the contour of the can periphery.

The operating sequences as they have been explained in the description of FIGS. 3 and 4 are reversible when the pneumatic cylinders are accordingly reversed.

Instead of the pneumatic cylinders, hydraulic cylinders, electromagnets or mechanical actuating elements may be provided for actuating the lifting arms and the parallel levers.

The sequence of movement of the elements of the device within the can manipulating device 39 from the basic position of the gripper elements to the gripping of a sliver can standing at ready, will be explained with the aid of FIGS. 5*a* to *d*. FIGS. 5*a* to 5*d* show views of the open can manipulating device 39. Double members are illustrated only once when they are covered up by members lying in front.

Figure 5A:
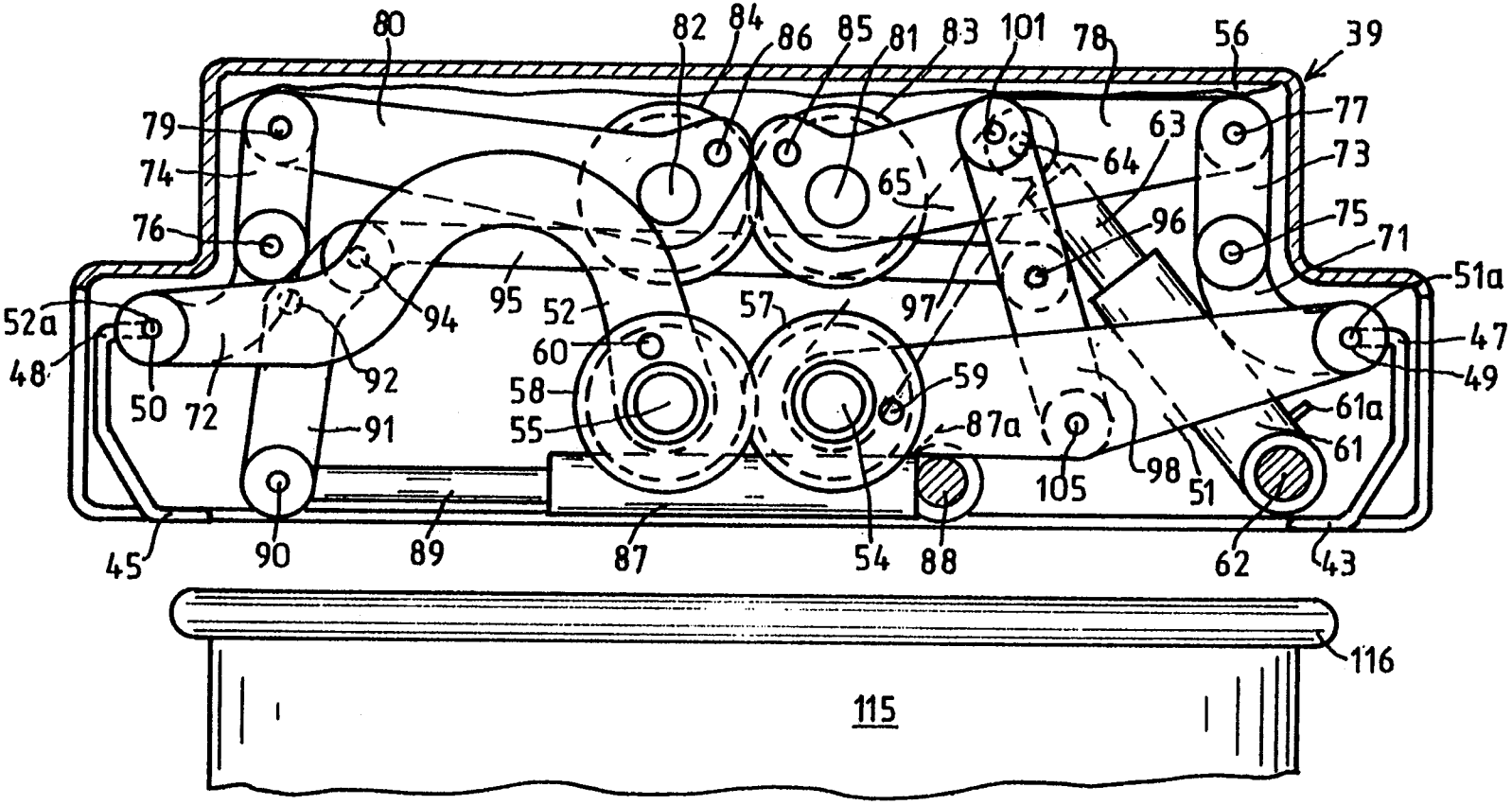

FIG. 5*a* shows the can manipulating device 39 with the gripper elements 43 to 46 in their normal position. The gripper elements, of which only the forward elements 43 and 45 can be seen, are lifted up and pivoted into their normal position. They are thereby drawn into the housing of the can manipulating device and they do not protrude beyond its contour. The can manipulating device 39 is therefore characterized by a small structural height and compact construction. This is beneficial with regard to the size of the can transport carriage. The small structural height additionally makes it possible to drive the can manipulating device under work stations of sliver-processing textile machines in which there is usually very little space between the sliver cans and the work stations.

In contrast to FIG. 3, the lifting arms 51, 51' 52 and 52' are in a raised position, so that the gripper elements 43 to 46 are drawn into the housing of the can manipulating device. The piston 63 of the pneumatic cylinder 61 is extended, which has caused the actuating lever 65 to pivot counter-clockwise and to perform a counter-clockwise rotation of the gear wheel 57, which is connected through the shaft 54. The lifting arms 51 and 51' have been raised by the fixing rod 59. Since the gear wheel 58 meshes with the gear wheel 57, the lifting arms 52 and 52' are also in a raised position.

The piston 89 of the pneumatic cylinder 87 for actuating the parallel levers 78 and 80 is also extended, in contrast to FIG. 3. The actuating lever 91 has been pivoted about the joint 92 in such a way that the connecting bar 95 has rotated the two members 97 and 98 into an extended position, in alignment with one another. The parallel lever 78 has thus been raised. Due to the coupling with the gear wheel 83 by means of the connecting bolt 85, the gear wheel 83 has been rotated counter-clockwise. The gear wheel 84 communicating therewith has been rotated clockwise and, by means of the connecting bolt 86, it has taken the parallel lever 80 with it and pivoted the same about the shaft 82 in a clockwise sense, so that it was raised as well. During the upward pivoting movement, the parallel lever 78 has actuated the pivot lever pair 71 through the coupling member 73, which has caused the holder 47 to pivot clockwise on the shaft 49 that is supported in the articulating point 51*a*, in such a way that the gripper elements 43 and 44 have been pivoted into the resting position. The parallel lever 80 has pivoted the pivot lever pair 72 through the coupling member 74. The holder 48, which is rigidly connected to the pivot lever pair 72, has pivoted counter-clockwise on the shaft 50 which is supported in the bearing 52*a*. The gripper elements 45 and 46 have thus also been pivoted into the resting position.

Figure 5B:
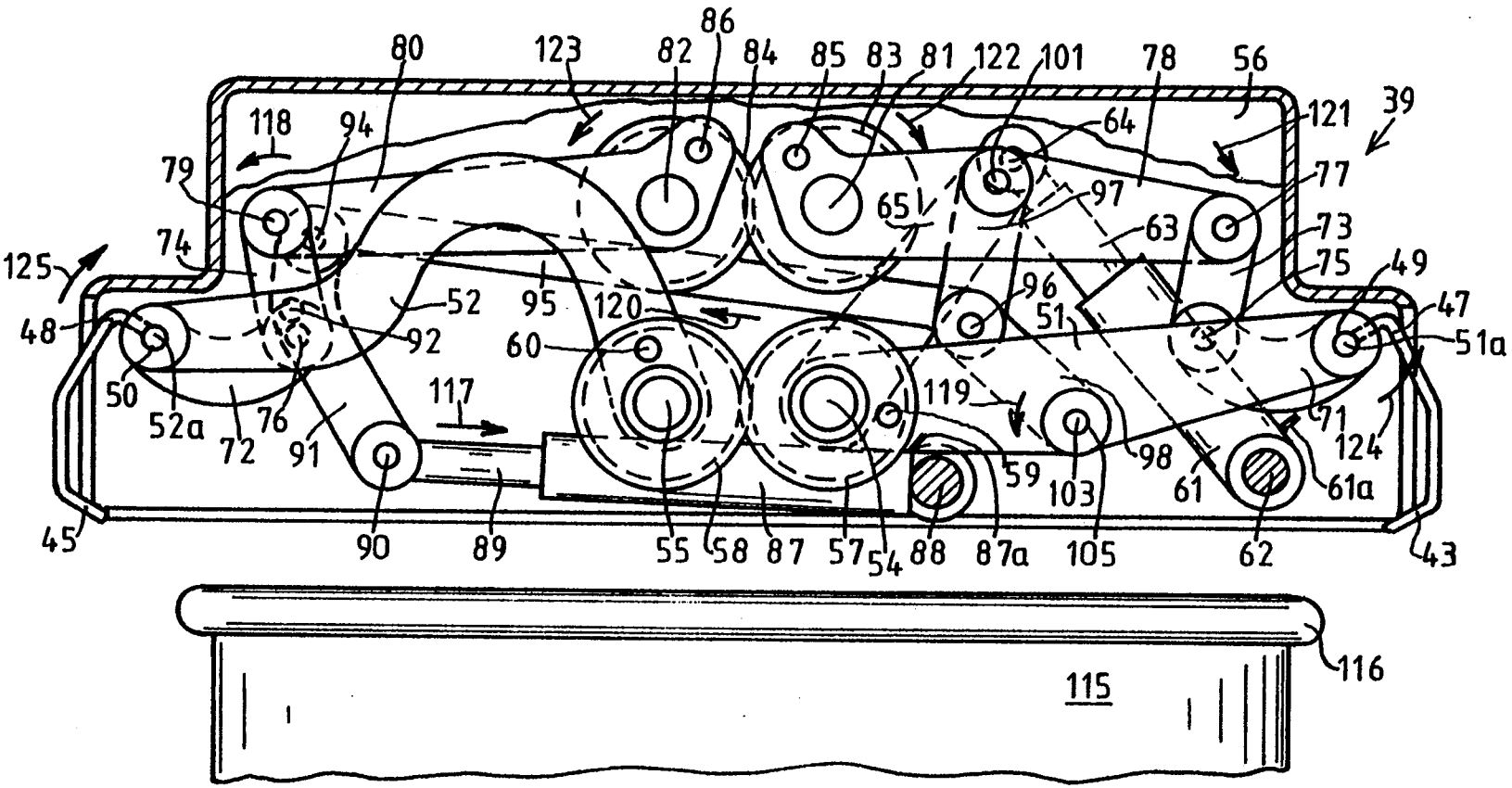

FIG. 5*b* shows the gripper elements in an opened position. In order to open the gripper elements, the pneumatic cylinder 87 receives an order over the control line 87*a* to retract the piston 89, as is indicated by an arrow 117. The actuating lever 91, which is hinged on the piston 89 in the joint 90, rotates about the joint 92, which causes the joint 94 to pivot counter-clockwise, as is indicated by an arrow 118. This effects a pulling force on the connecting rod 95, as is indicated by an arrow 120. The force acts in the joint 96, in which the members 97 and 98 are supported. Since the piston 63 is not actuated, the lifting arms 51 and 51' remain still. The member 98 rests on the connecting bolt 103, it thus pivots counter-clockwise about the connecting bolt 103, as is indicated by an arrow 119, and it takes the member 97 with it. The member 97 thus pulls the parallel lever 78 downward in the direction of an arrow 121 from its rest position illustrated in FIG. 5*a*. The parallel lever 78 thereby pivots about the shaft 81 and by means of the connecting bolt 85 it takes the gear wheel 83 with it which rotates clockwise according to an arrow 122. Due to the fact that the gear wheel 83 meshes with the gear wheel 84, the same rotates in an opposite direction 123. The two parallel levers 78 and 80 are therefore simultaneously moved downward. The parallel lever 78 pushes the coupling member 73, which pivots the pivot lever pair 71 on the shaft 49. The holder 47, which is rigidly connected with the pivot lever pair 71, is therefore pivoted counter-clockwise, according to an arrow 124. Accordingly, the gripper elements 43 and 44 are pivoted outwardly and thus opened for gripping a rim of a can. The actuation of the gripper elements 45 and 46 is effected in mirror symmetry. The downwardly moving parallel lever 80 presses on the coupling member 74, which pivots the pivot lever pair 72 clockwise about the shaft 50, in the direction of an arrow 125. Accordingly, the holder 48, which is rigidly connected with the pivot lever pair 72, is also pivoted clockwise about the shaft 50. During the pivoting motion, the gripper elements 45 and 46 are also pivoted and they move outward. The gripper elements are thus opened for gripping the rim of a can.

Figure 5C:
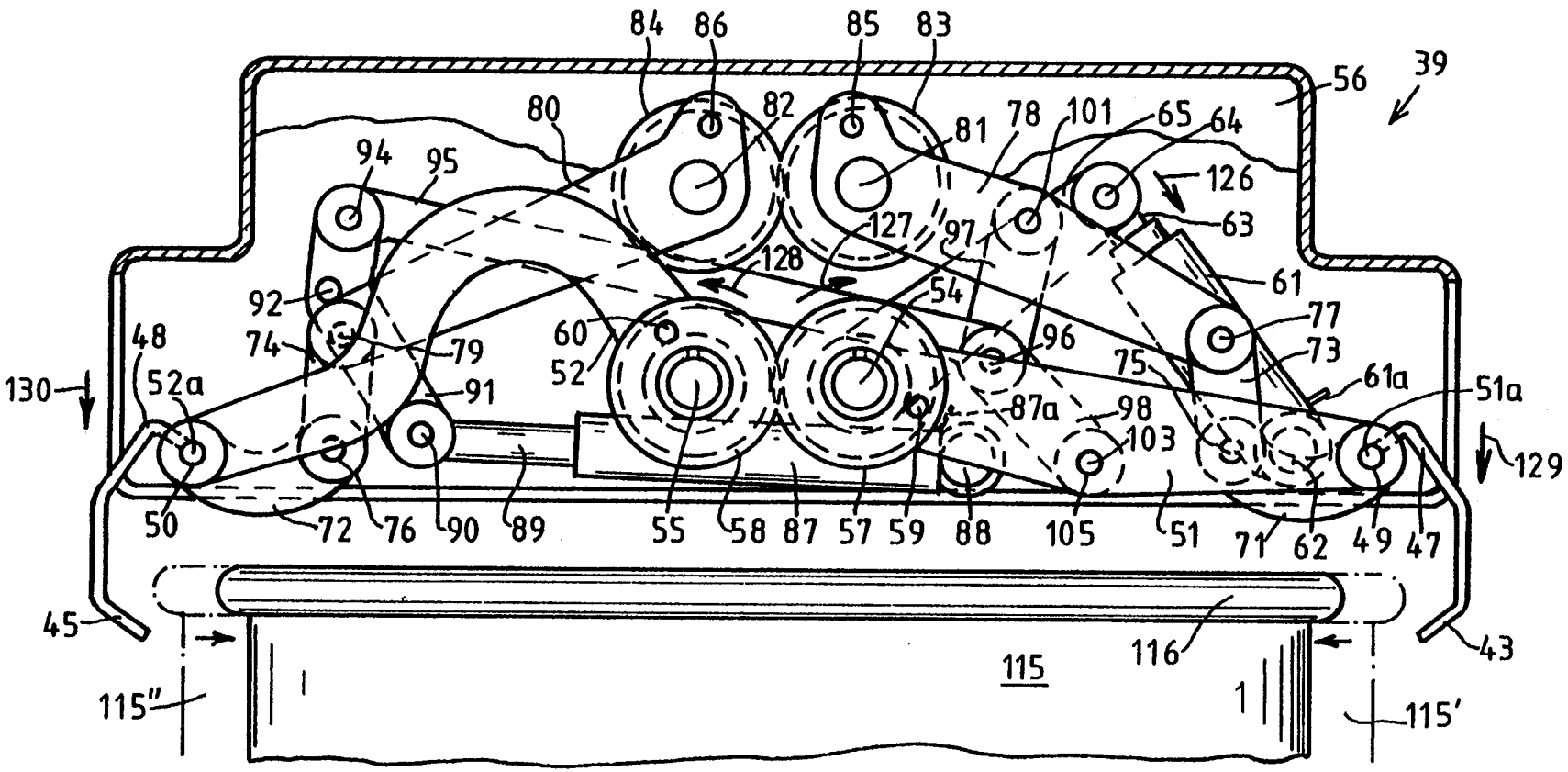

FIG. 5*c* depicts the can manipulating device 39 with lowered gripper elements in an open position.

In order to the move the gripper elements into this position, the lifting arms must be actuated. The pneumatic cylinder 61 receives a signal through the control line 61*a*, to retract its piston 63 in the direction of an arrow 126. This causes the actuating lever 65 to pivot clockwise together with the rigidly connected shaft 54. The gear wheel 57 which is also rigidly connected with the shaft 54, pivots clockwise as well, as is indicated by an arrow 127. The gear wheel 58, which meshes with the gear wheel 57, simultaneously rotates counter-clockwise in a direction 128. The lifting arms 51 and 51' are slaved along by the fixing rod 59 and they also pivot in the direction of the arrow 127 in the joint 51*b* about the shaft 54. Due to the fact that the lifting arms 52 and 52' are rigidly connected with the gear wheel 58 by the fixing rod 60, these lifting arms rotate counter-clockwise simultaneously and synchronously with the other lifting arms in their joints 52*b* and 52'*b* about the shaft 55, according to the direction 128.

Since the pneumatic cylinder 87 is not actuated, the lever system formed of the members 91, 95, 97 and 98 remains stiff. The parallel levers 78 and 80 are thus forced to perform a pivoting motion which is parallel to that of the lifting arms. The gripper elements 43 to 46 remain in their open position. They are moved with a nearly vertical motion according to arrows 129 and 130 from the position which they occupy in FIG. 5*b* into the position which they occupy in FIG. 5*c*.

The gripper elements 43 to 46 hardly protrude outside the contour of the housing of the can manipulating device 39 during the lowering motion. This enables the gripper elements to be lowered even among closely adjacent cans. Even when the cans are positioned accurately, as is illustrated by contours 115' and 115" upon closing, the gripper elements which are lowered below the rim of the can are able to grip and transport the cans at accurately defined locations. This is depicted in FIG. 5*d*.

Figure 5D:
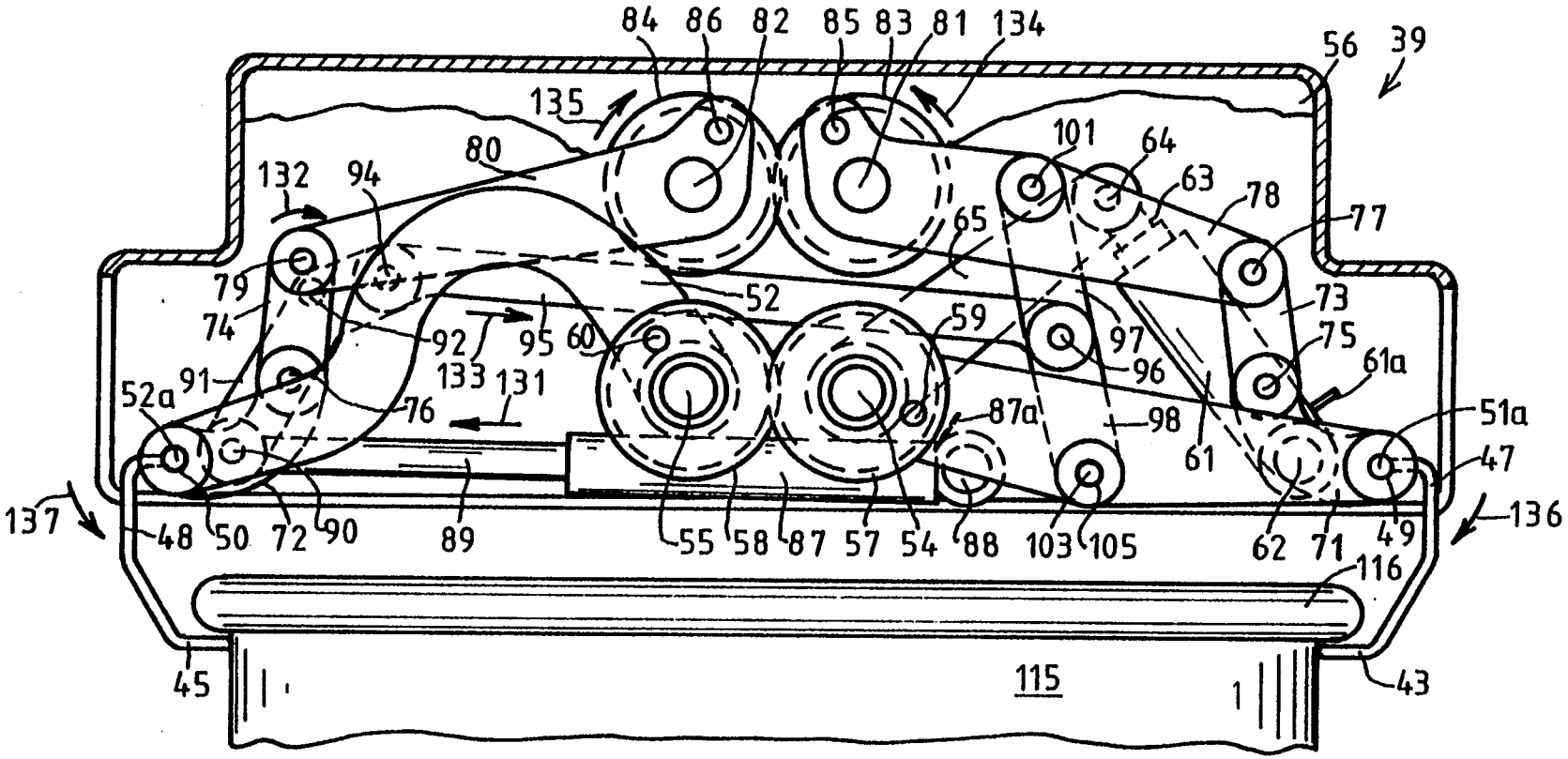

In FIG. 5*d*, the gripper elements 43 to 46 are pivoted into a gripping position, they have gripped the can 115 below the rim 116 of the can and have accurately positioned the same.

In order to grip the can, the pneumatic cylinder 87 receives an order over the control line 87*a* to extend its piston 89 in the direction of an arrow 131. This causes the actuating lever 91 to pivot clockwise in a direction 132 about the joint 92. The connecting rod 95 is shifted in the direction of an arrow 133 and it pushes the members 97 and 98 into the extended position. Since the lifting arms remain stationary, only the parallel levers 78 and 80 can move. As was already explained in the description of FIG. 3, the gear wheel 83 is also rotated in the direction of an arrow 134 when the parallel lever 78 is moved in the direction of the arrow 134. The gear wheel 84, which meshes with it, rotates in the opposite direction of an arrow 135. The gripper elements 43 and 44 are pivoted clockwise in the direction of an arrow 136 about the shaft 49 by the coupling member 73 and the pivot lever pair 71, in such a way that they grip below the rim of the can 116. The gripper elements 45 and 46 are synchronously pivoted. While the gear wheel 84 rotates clockwise according to the arrow 135, the parallel lever 80 is also pivoted clockwise and upward. The pivot lever pair 72 is pivoted counter-clockwise about the shaft 50, according to the direction of an arrow 137, by the coupling member 74. This causes the holder 48, which is rigidly connected to the pivot lever pair 72, to also pivot counter-clockwise, so that the gripper elements 45 and 46 are swung according to the arrow 137 into a gripping position below the rim 116 of the can.

The can 115 which is thus grabbed, can be lifted for transport. Such a position of the can manipulating device is not illustrated herein. In order to lift, it is sufficient for the pneumatic cylinder 61 to receive an order over the control line 61*a*, to extend the piston 63 by a given distance, corresponding to the desired height of the lift. The lifting arms are raised in accordance with the mutual association of the illustrated members. The gripper elements thereby remain in the closed position. The lifting need only be by a few centimeters, so that the can is not in contact with the floor. In this raised condition, the can may be moved by the can manipulating device 39. Due to the fact that the gripper elements may be opened and closed at any position of the lifting arms, i.e. at any distance along the possible lifting height, the can manipulating device allows for the equalization of level differences during the movement of cans.

Figure 6:
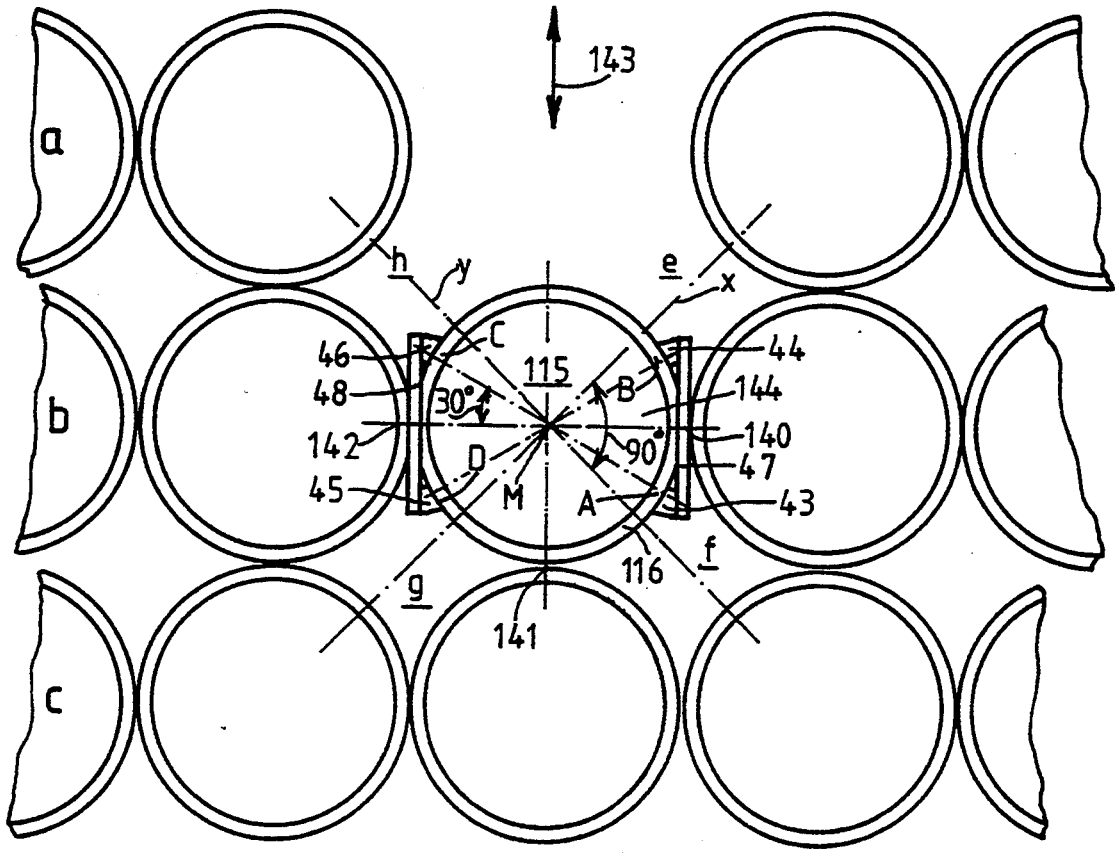
FIG. 6 is a fragmentary, top-plan view showing a configuration of the gripper elements of a can manipulating device during gripping of a can from a triple-row can configuration.

FIG. 6 shows a configuration of three rows of cans standing behind one another under the work stations of a non-illustrated sliver-processing textile machine. In order to place the cans as densely as possible, the rims of the cans abut one another. A row "a" of cans stands frontally by the textile machine, while rows b and c of cans face the textile machine. They may already stand under the work stations of the sliver processing textile machine. The can 115, which was already mentioned in the foregoing description of the exemplary embodiments, stands in the center row b of the cans. The can standing in front thereof has already been removed, so that a can exchange may be performed. Due to the dense packing of the cans, the periphery of the can 115 touches the three adjacent cans at points 140 to 142. The points of contact are distributed about the circumference of the rim 116 at respective angles of approximately 90 degrees. The greatest intermediate spaces among the cans lie in the region of a half-angle line x of the angle between the points of contact 141 and 142 as well as in the region of the half-angle line y of the angle between the points of contact 140 and 141. In order to enable the raising of a can without disturbing the position of the adjacent cans during the handling of the cans in accordance with the object of the invention, the gripper elements must dip or dive into the greatest intermediate spaces e, f, g and h in the region of the half-angle lines x and y. When the gripper elements dip into these intermediate spaces, they are able to grab the can to be exchanged and to transport the same without interfering with the adjacent cans. Each two of the gripper elements 43 and 44 as well as 45 and 46 are connected with a respective one of the holders 47 and 48, which lie parallel relative to one another and to a direction of movement 143 of the can manipulating device 39.

The gripper elements grab the can right and left of the travel path of the can manipulating device. When the can manipulating device is moved according to the double arrow 143 in FIG. 6 perpendicularly to the rows a, b and c of cans, the gripper elements according to the invention lie respectively behind one another in the direction of movement 143, so that after the can manipulating device has been positioned, the gripper element 43 dips into the intermediate space f, the gripper element 44 dips into the intermediate space e, the gripper element 45 dips into the intermediate space g, the gripper element 46 dips into the intermediate space h. During the lowering operation, to the greatest extent possible, the gripper elements should avoid the points of contact 140 and 142 which are located right and left with respect to the direction of travel 143 of the can manipulating device, so as not to endanger the position of the cans adjacent the can 115. Optimal distribution of the gripper elements is attained when they are disposed at an angle of between 20 and 45 degrees respectively, right and left of a line 144 connecting the points of contact 140 and 142, relative to a center point M of the can. In the instant exemplary embodiment, the gripper elements are each disposed at an angle of 30 degrees with regard to the connecting line, relative to the center point M of the can. At this angle relative to the connecting line 144, the four mutually spaced-apart points A, B, C and D are also disposed on the periphery of the rim of the can, at locations where the gripper elements grab the can 115.

Figure 7:
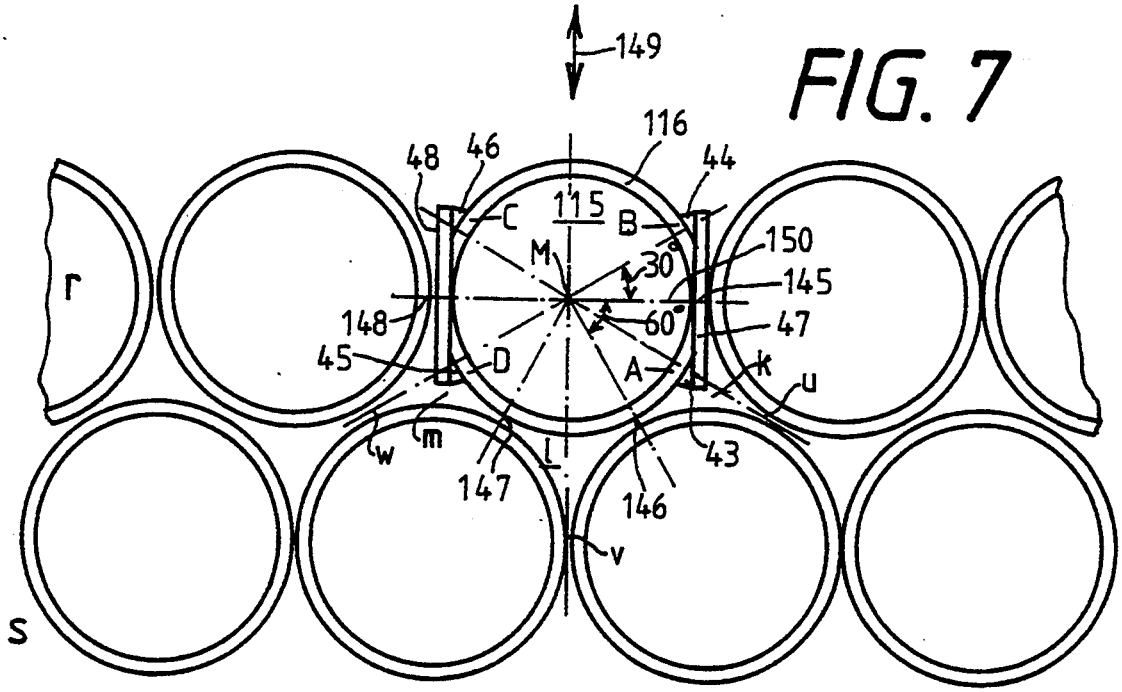
FIG. 7 is a fragmentary, top-plan view showing gripping of a can from a double-row of cans in the densest packing.

FIG. 7 shows a double row r and s of cans, in a densest packing. The configuration of the cans forms a pattern of equilateral triangles. In the configuration illustrated herein, each can touches two cans of the other row and two cans of its own row. The can 115 in the row r touches adjacent cans of its own row at points 145 and 148. Numerals 146 and 147 refer to points of contact with the cans of the row s. The points of contact are located at respective angles of 60 degrees relative to one another, which are distributed about the periphery of the rim 116 of the can 115. Greatest intermediate spaces k, l and m are respectively located in the region of a half-angle line u between the points of contact 145 and 146, of a half-angle line v between the points of contact 146 and 147, as well as of a half-angle line w between the points of contact 147 and 148.

A can manipulating device according to the invention having gripper elements thereof which are disposed as illustrated in FIG. 6 and as described, is able to handle the cans in the instantly considered can configuration without disturbing the adjacent cans. Since the gripper elements 43, 44, 45 and 46 are also disposed at an angle of 30 degrees with regard to a line 150 connecting the points of contact 145 and 148 through the center point M of the can 115, they dip into the greatest intermediate spaces k and m between the cans when the can manipulating device 39 is brought in according to a directional arrow 149 and positioned above the can 115.

The locations A and C, at which the gripper elements 43 and 46 respectively grab the rim of the can, are located at the points where the half angle line u intersects the rim of the can. The locations B and D, at which the gripper elements 44 and 45 respectively grab the rim of the can, are located at the intersections between the half angle line w and the rim of the can.

We claim:

1. In sliver-processing textile machines and can exchange stations including a can transport carriage to be moved in a given direction of motion for manipulating sliver cans having upper rims with outer peripheries, a can manipulating device being movable on the can transport carriage above the cans in a direction transverse to the given direction of motion for manipulating the sliver cans during an automatic can exchange, comprising:

four gripper elements for gripping the sliver cans to be manipulated at four mutually spaced-apart locations at the outer peripheries of the upper rims of the cans;

first means associated with two of said four gripper elements for simultaneously actuating said two gripper elements, and second means associated with the other two of said four gripper elements for simultaneously actuating said other two gripper elements, said first and second means being mechanically coupled for simultaneously actuating said four gripper elements;

the cans being disposed adjacent and behind one another in rows defining areas of greatest intermediate spaces between the cans, and said gripper elements gripping the cans in the areas of greatest intermediate spaces; and means for simultaneously raising and lowering said gripper elements for lifting and depositing the cans with substantially vertical lifting strokes, and means for pivoting said gripper elements for gripping and releasing the cans in any lifting position.

2. The can manipulating device according to claim 1, including mutually parallel holders each being connected to a respective two of said gripper elements, said holders being parallel to the direction of movement of the can manipulating device, and each two of said gripper elements connected to one of said holders being disposed one behind the other as seen in the directions of movement of the can manipulating device.

3. In sliver-processing textile machines and can exchange stations including a can transport carriage to be moved in a given direction of motion for manipulating sliver cans having upper rims with outer peripheries, a can manipulating device being movable on the can transport carriage above the cans in a direction transverse to the given direction of motion for manipulating the sliver cans during an automatic can exchange, comprising:

four gripper elements for gripping the sliver cans to be manipulated at four mutually spaced-apart locations at the outer peripheries of the upper rims of the cans, lifter arms for raising and lowering said gripper elements, each two of said gripper elements being disposed behind one another in the directions of movement of the can manipulating device and being pivotally mounted on at least one of said lifter arms, said lifter arms being in operative connection for synchronously raising and lowering said gripper elements, an actuating device for actuating said lifter arms, parallel levers for pivoting said gripper elements, coupling members connecting said parallel levers with said gripper elements, said parallel levers being operatively connected for synchronously pivoting said gripper elements, and an actuating device for actuating said parallel levers.

4. The can manipulating device according to claim 3, wherein said lifter arms and said parallel levers include lifter arms and parallel levers being disposed one above the other for actuating the same one of said gripper elements, said parallel levers are disposed above said lifter arms, and including pivot lever pairs, said parallel levers being connected with said lifter arms by said coupling members and said pivot lever pairs for actuating said gripper elements.

5. The can manipulating device according to claim 4, including mutually articulatingly coupled members and a joint interconnecting said coupled members, said lifter arms and said parallel levers being connected by said coupled members, and said actuating member for said parallel levers engaging said joint.

6. The can manipulating device according to claim 3, including mutually articulatingly coupled members and a joint interconnecting said coupled members, said lifter arms and said parallel levers being connected by said coupled members, and said actuating member for said parallel levers engaging said joint.

7. In sliver-processing textile machines and can exchange stations including a can transport carriage to be moved in a given direction of motion for manipulating sliver cans having upper rims with outer peripheries, a can manipulating device being movable on the can transport carriage above the cans in a direction transverse to the given direction of motion for manipulating the sliver cans during an automatic can exchange, comprising:

first, second, third and fourth gripper elements to be operated simultaneously for gripping the sliver cans to be manipulated at four mutually spaced-apart locations at the outer peripheries of the upper rims of the cans, said first and third gripper elements together defining a first diametrical line through a center of a can to be gripped, said second and fourth gripper elements together defining a second diametrical line through the center of the can to be gripped, said first and second diametrical lines defining an angle of substantially 60° therebetween, first means associated with said first and second gripper elements for simultaneously actuating said first and second gripper elements, and second means associated with said third and fourth grippers for simultaneously actuating said third and fourth gripper elements, said first and second means being mechanically coupled for simultaneously actuating said gripper elements.

8. The can manipulating device according to claim 7, including mutually parallel holders each being connected to a respective two of said gripper elements, said holders being parallel to the direction of movement of the can manipulating device, and each two of said gripper elements connected to one of said holders being disposed one behind the other as seen in the directions of movement of the can manipulating device.

9. The can manipulating device according to claim 7, including means for raising and lowering said gripper elements for lifting and depositing the cans with substantially vertical lifting strokes, and means for pivoting said gripper elements for gripping and releasing the cans in any lifting position.

10. In sliver-processing textile machines and can exchange stations including a can transport carriage to be moved in a given direction of motion for manipulating sliver cans having upper rims with outer peripheries, a can manipulating device being movable on the can transport carriage above the cans in a direction transverse to the given direction of motion for manipulating the sliver cans during an automatic can exchange, comprising: four gripper elements for gripping the sliver cans to be manipulated at four mutually spaced-apart locations at the outer peripheries of the upper rims of the cans;

the cans being disposed adjacent and Behind one another in rows defining areas of greatest intermediate spaces between the cans, and said gripper elements gripping the cans in the areas of greatest intermediate spaces;

means for simultaneously raising and lowering said gripper elements for lifting and depositing the cans with substantially vertical lifting strokes, and means for pivoting said gripper elements for gripping and releasing the cans in any lifting position; and a housing having a contour, said gripper elements being drawn into said housing in a normal position in which said gripper elements do not protrude beyond said contour.

11. In sliver-processing textile machines and can exchange stations including a can transport carriage to be moved in a given direction of motion for manipulating sliver cans having upper rims with outer peripheries.

a can manipulating device being movable on the can transport carriage above the cans in a direction transverse to the given direction of motion for manipulating the sliver cans during an automatic can exchange, comprising:

first, second, third and fourth gripper elements to be operated simultaneously for gripping the sliver cans to be manipulated at four mutually spaced-apart locations at the outer peripheries of the upper rims of the cans, said first and third gripper elements together defining a first diametrical line through a center of a can to be gripped, said second and fourth gripper elements together defining a second diametrical line through the center of the can to be gripped, said first and second diametrical lines defining an angle of substantially 60° therebetween; and a housing having a contour, said gripper elements being drawn into said housing in a normal position in which said gripper elements do not protrude beyond said contour.

* * * * *